United States Patent [19]

Woodling

[11] 4,368,011

[45] Jan. 11, 1983

[54] CYLINDRICAL TOOTH SET HAVING A CONCAVE SOCKET AND A CYLINDRICAL TOOTH ENGAGING EACH OTHER ON THE TRANSVERSE LINE OF ECCENTRICITY

[76] Inventor: George V. Woodling, 22077 Lake Rd., Rocky River, Ohio 44116

[21] Appl. No.: 196,740

[22] Filed: Oct. 14, 1980

[51] Int. Cl.[3] ..... F01C 1/113; F16H 1/28; F16H 55/10

[52] U.S. Cl. ..... 418/61 B; 74/804

[58] Field of Search ..... 418/61 B; 74/804, 805

[56] References Cited

U.S. PATENT DOCUMENTS

| | | | |
|---|---|---|---|
| 3,601,513 | 8/1971 | White, Jr. | 418/61 B |
| 3,668,947 | 6/1972 | Waldorff | 418/61 B |
| 3,784,336 | 1/1974 | Schultz | 418/61 B |
| 3,979,167 | 9/1976 | Grove | 418/61 B |

FOREIGN PATENT DOCUMENTS

| | | | |
|---|---|---|---|
| 1059495 | 11/1953 | France | 418/61 B |

*Primary Examiner*—John J. Vrablik

*Attorney, Agent, or Firm*—Woodling, Krost & Rust

[57] ABSTRACT

A cylindrical tooth set having two sets of cylindrical teeth, one set being mounted in a rotor tooth member and the other set being mounted in a stator tooth member. The rotor tooth member is provided with a plurality of an odd number of cylindrical teeth and the stator tooth member is provided with a plurality of an even number of cylindrical teeth. The rotor tooth member is further provided with a plurality of concave sockets between the rotor teeth thereof. One of said concave sockets and one of said stator teeth being disposed to engage each other on the transverse line of eccentricity.

10 Claims, 9 Drawing Figures

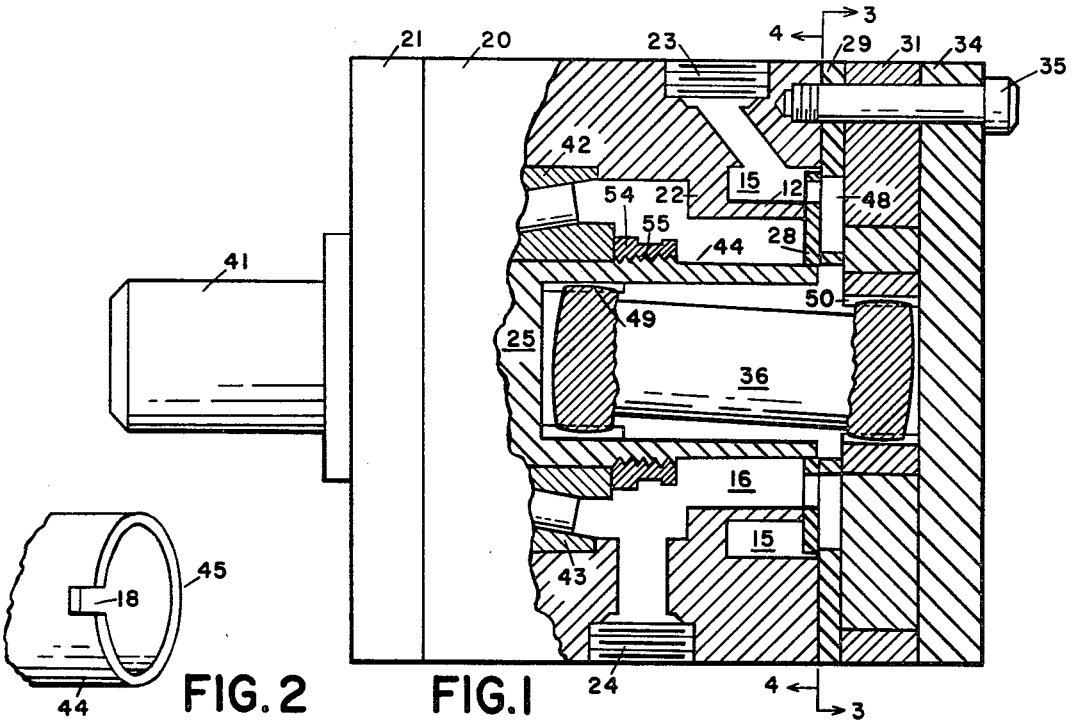
FIG. 1
FIG. 2
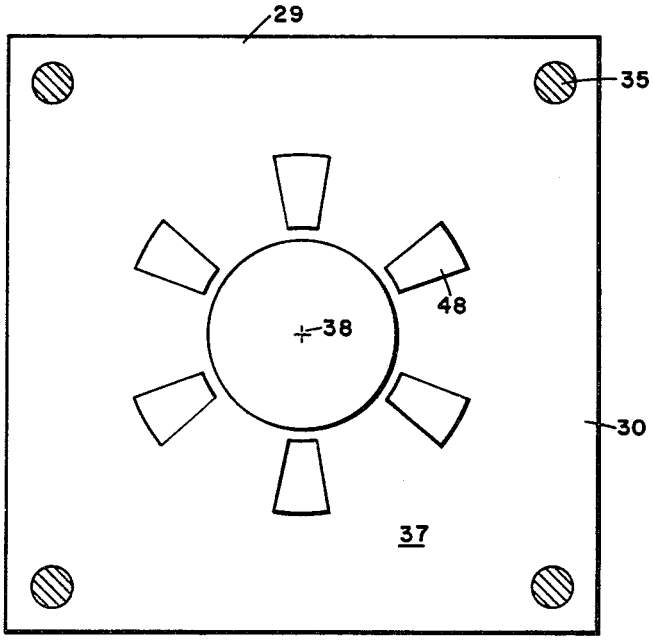
FIG. 3
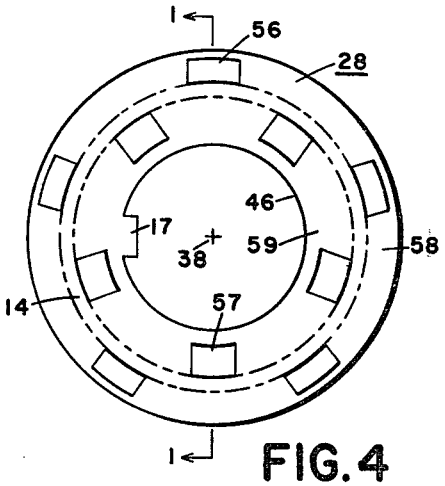
FIG. 4
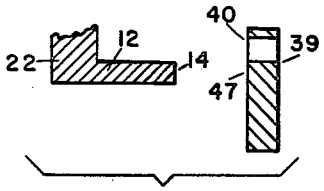
FIG. 5

CYLINDRICAL TOOTH SET HAVING A CONCAVE SOCKET AND A CYLINDRICAL TOOTH ENGAGING EACH OTHER ON THE TRANSVERSE LINE OF ECCENTRICITY

BACKGROUND OF THE INVENTION

My cylindrical tooth set comprises two sets of cylindrical teeth, one set being mounted in a rotor tooth member and the other set being mounted in a stator tooth member. All of the teeth in my cylindrical tooth set comprise cylindrical teeth mounted in fragmental cylindrical recesses. The diameter of each cylindrical tooth is substantially the same as the diameter of a corresponding recess. The rotor tooth member may be provided with a plurality of an odd number of cylindrical teeth and the stator tooth member may be provided with a plurality of an even number of cylindrical teeth.

The teeth of the rotor and stator tooth members are disposed to intermesh with each other and form expandable and contractable fluid chambers therebetween. The teeth in the rotor tooth member may be referred to as rotor teeth and the teeth in the stator tooth member may be referred to as stator teeth. Also, the axis of the rotor tooth member may be referred to as rotor axis and the axis of the stator tooth members may be referred to as stator axis. The rotor teeth are one less in number than the number of the stator teeth. The benefits derived from my odd-rotor and even-stator tooth arrangement is closely related to a fundamental principle involving the transverse line of eccentricity. As understood herein, the term transverse line of eccentricity means a line, being a profile of a plane, which mutually intersects the stator and rotor axes at all times, as they orbit relative to each other. As the rotor axis and the stator axis orbit relative to each other, the transverse line of eccentricity is caused to rotate therearound at orbit speed and in an opposite direction to the speed of rotation. Adherence to the transverse eccentricity line principle is essential to the operation of my cylindrical tooth set having expandable and contractable fluid chambers. It serves to indicate the dividing line between the two fluid chambers and is related, in a timing sense, to the valving which controls the flow of fluid to and from the expandable and contractable fluid chambers.

My tooth set is unique in that a stator tooth in the stator tooth member and a concave socket in the rotor tooth member are disposed to define a concave-to-convex contact relationship on the transverse line of eccentricity.

An object of my invention is to reduce tooth wear as well as tooth friction.

Another object is to prevent internal leakage from flowing between the fluid chambers where the transverse line of eccentricity extends thereacross at diametrically opposite places.

Another object is to provide concave sockets on the rotor tooth member.

Another object is to provide for one of the concave sockets and for one of the cylindrical stator teeth to engage each other and define a concave-to-convex contact relationship therebetween.

Another object is to provide for the cylindrical recesses to have substantially the same diameter as that of the cylindrical teeth mounted therein, and thereby preferably define a close clearance fit therebetween.

Another object is to provide for smooth orbiting of the tooth members relative to each other.

Another object is to provide for mechanically supporting the tooth members relative to each other on the transverse line of eccentricity and thereby eliminate the need for a revolving crank as a support.

Another object is to provide for the concave-to-convex contact relationship to mechanically support the tooth members relative to each other on the transverse line of eccentricity.

Another object is to provide for the concave-to-convex contact relationship to sealingly separate the fluid chambers on the transverse line of eccentricity.

Another object is to provide for the diameter of the stator teeth to be greater than the diameter of the rotor teeth.

SUMMARY OF THE INVENTION

The invention constitutes a cylindrical tooth set comprising a rotor tooth member having a longitudinal rotor axis, a stator tooth member surrounding said rotor tooth member and having a longitudinal stator axis substantially parallel to said rotor axis, said rotor axis and said stator axis being mutually spaced apart from each other and defining a transverse line of eccentricity passing therethrough, the longitudinal axis of one of said tooth members being disposed to move in an orbital cycle about the longitudinal axis of the other of said tooth members, said rotor tooth member having an outer face, said outer face having said rotor axis as a center, said stator tooth member having an inner face, said inner face having said stator axis as a center, said rotor tooth member having mounted therein a plurality of rotor cylindrical teeth projecting outwardly from said outer face thereof, all of said rotor teeth having substantially the same rotor tooth diameter and being spaced apart one from the other in a circumferential direction, said stator tooth member having mounted therein a plurality of stator cylindrical teeth projecting inwardly from said inner face thereof, said rotor teeth being one less in number than the number of said stator teeth, all of said stator teeth having substantially the same stator tooth diameter and being spaced apart one from the other in a circumferential direction, said rotor and stator teeth being disposed to intermesh with each other and form expandable and contractable fluid chambers therebetween, said rotor tooth member defining a plurality of rotor body portions between the rotor teeth thereof, all of said rotor body portions having substantially the same circumferential width and respectively being provided with a longitudinal concave socket, one of said concave sockets being referred to as a middle concave socket and one of said plurality of cylindrical stator teeth being referred to as a middle stator tooth, said middle concave socket and said middle stator tooth being disposed to provide a concave-to-convex contact relationship therebetween, said middle stator tooth in said contact relationship defining an individual stator tooth axis, said concave socket in said relationship defining an individual socket axis, said transverse line of eccentricity passing through said individual stator tooth axis and said individual socket axis.

BRIEF DESCRIPTION OF THE DRAWINGS

Other objects and a fuller understanding of the invention may be had by referring to the following description and claims, taken in conjunction with the accompanying drawings, in which:

FIG. 1 is a partial cross-sectional view of a fluid pressure assembly including my cylindrical tooth set, the view through the valving being taken along the line 1—1 of FIG. 4;

FIG. 2 is a representation of a male shank provided on a terminal end portion of a hollow shaft adapted to slidably fit within a female opening in a rotary valve member;

FIG. 3 is a view of the front side of a stationary valve member, taken along the line 3—3 of FIG. 1;

FIG. 4 is a view of the back side of the rotary valve member, taken along the line 4—4 of FIG. 1;

FIG. 5 is a combined drawing respectively showing a cross-section of a hollow integral housing wall and the rotary valve member in FIG. 1, the views being separated from each other but tied together by a bracket to facilitate the placing of additional reference characters on the separate parts;

DESCRIPTION OF THE PREFERRED EMBODIMENT

Figure 7:
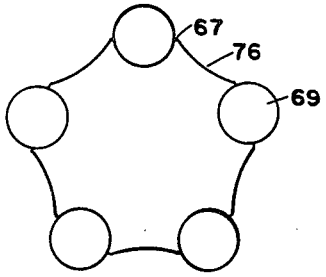
FIG. 7 is a diagrammatical profile view of the rotor tooth member showing concave sockets between the rotor teeth, the internal female dogbone teeth not being shown.

The fluid pressure assembly comprises generally a main housing 20 having substantially a square cross-section. A mounting flange 21 may be secured to the left-hand end of the housing by means of suitable screws, not shown. The housing is hollow from end-to-end and intermediate the ends of the housing there is provided an internal wall 22 generally separating the hollow housing into a lefthand end compartment and a right-hand end compartment. Extending from the internal wall 22 is a hollow separating wall 12 terminating in a hollow blank surface 14. The hollow separating wall 12 is integral with the main housing 20 and so is the hollow blank surface 14.

Rotatively mounted in the lefthand end compartment is a main load shaft 25 having an axis substantially coinciding with the longitudinal axis of the fluid pressure assembly. The main shaft 25 comprises an enlarged internal portion having a reduced external portion 41 extending axially outwardly of the main housing through the mounting flange 21. The enlarged internal portion of the main shaft is supported preferably by tapered roller bearings 42 and 43 which provide end thrust as well as radial thrust. A tightening nut 54 which threadably engages male threads 55 secures the bearings 42 and 43 against axial movement upon the main shaft. The tightening nut 54 may be provided with a built-in locking feature to prevent loosening.

The righthand end compartment comprises a valve compartment having an open end against which a square stationary valve member 29 is mounted. The stationary valve member 29 has a stationary valve face 37 disposed substantially parallel to the hollow blank surface 14 and is axially spaced therefrom. In the valve compartment and between the stationary valve face 37 and the hollow blank surface 14, there is mounted a rotary valve member 28 adapted to be rotated relative to the stationary valve face 37 for controlling the entrance of fluid to and the exit of fluid from my cylindrical tooth set 31 comprising a rotor tooth member 32 and a stator tooth member 33. In operation, the rotor tooth member 32 and the stator tooth member 33 form expandable and contractable fluid chambers. An end cap 34 and the cylindrical tooth set 31, along with the stationary valve member 29, are secured to the main housing 20 by means of screws 35. Fluid is delivered to and from the housing 20 through a pair of fluid ports 23 and 24. An interconnecting dogbone shaft 36 interconnects the rotary valve member 28 and the rotor tooth member 32, whereby the rotary valve member is rotated at the same speed as that of the rotor tooth member 32.

The bearings 42 and 43 constitute a common bearing means for the main shaft 25 and the rotary valve member 28. The common bearing means directly supports the main shaft 25 and indirectly supports the rotary valve member 28 through the extension drive means comprising a hollow shaft 44 integrally connected to the main shaft 25. The hollow shaft 44 extends into the valve compartment to make a driving connection with the rotary valve member 28 for driving same. The hollow shaft 44 terminates with a male shank 45 which slideably fits within a female opening 46 provided in the rotary valve member 28; see FIGS. 2 and 4. This connection comprises a non-rotative connection consisting of a tongue 17 fitting into an axial slot 18 and rotates the rotary valve member 28 upon rotation by the main shaft. This connection also provides slideable axial movement between the rotary valve member 28 and the hollow shaft 44 to accommodate for axial movement of the main shaft without interfering with the operation of the rotary valve member 28.

The stationary valve member 29 is positioned on longitudinal axis 38 about which the rotary valve member rotates. It is disposed between the rotary valve member 28 and the cylindrical tooth set 31 and is provided with a plurality of fluid conducting openings 48 arranged in a ring about the axis 38 and in constant fluid communication with the fluid chambers.

As illustrated in FIG. 4, the rotary valve member 28 has substantially identical flat sides 39 and 40. The side 39 may be referred to as a valve side, as it operates as a valve surface. The side 40 may be referred to as a ring side, of which only a narrow ring blank surface 47 is utilized, being small in area. The entire valve side 39 is disposed to sealingly engage the stationary valve face 37 and defines therewith a commutating interface valve comprising a large interface valve area. The narrow ring blank surface 47 is disposed to sealingly rub against the hollow blank surface 14. The narrow ring blank 47 is continuously circular and defines in combination with the hollow blank surface 14 a small interface blank area as compared to the large interface valve area.

The hollow separating wall 12 provides an outer valve chamber 15 and an inner valve chamber 16, disposed to be oppositely pressurized from the fluid ports 23 and 24, whereby when one is pressurized the other is at exhaust pressure.

As shown in FIG. 4, the rotary valve member 28 has an outer series of commutating fluid passages 56 and an inner series of commutating fluid passage 57. The fluid passages extend straight through the rotary valve member 28 and are alternately disposed with respect to each other. The passages are adapted to connect commutatively the outer and inner valve chambers 15 and 16 to the fluid conducting openings 48 in the stationary valve face 37 during rotation of the rotary valve member 28. The fluid passages in each series are one less in number than the number of the fluid conducting openings 48 in the stationary valve face.

In FIG. 4, the outer and inner series of fluid passages 56 and 57 are shown as defining rectangular conducting openings or spaces.

In practice, the valve side 39 and the ring side 40 may be treated for hardness in the same treatment operation. Accordingly, both sides of the rotary valve member have substantially the same hardness value for resisting wear which means that the narrow ring blank surface 47 is likewise of the same hardness. The stationary valve face 37 is also treated for hardness so that it may resist wear.

As previously noted, the valve side 39 and the stationary valve face 37 are substantially free from frictional wear, as these surfaces have a large resistance to wear, plus a large area.

As desired, the blank seal surface 14 is subject to wear, being made of soft metal the same as the valve housing 20. In assembly, the soft metal rubs against the hard narrow ring blank surface 47 and is wearable thereby to provide an ideal tolerance space therebetween which stops wearing the instant that the hydraulic fluid begins to seep between the soft and hard metal surfaces 14 and 47. This wear and seepage situation may be referred to a lubricated wear factor.

Since the hard narrow ring blank surface 47 is disposed intermediate the fluid passages 56 and 57, the outer radially extending part of the ring side 40, being identified by the reference number 58, is exposed to fluid pressure in the outer valve chamber 15 and, similarly, the inner radially extending part 59 is exposed to fluid pressure in the inner valve chamber 16. This tends to provide a fluid force in a direction to urge the valve side 39 against the stationary valve face 37 to prevent interface valve leakage and to urge the ring side 40 away from the soft metal of the hollow blank surface 14 to prevent further wear. The tolerance factor as it wears in always comes out ideal; namely, to what the lubricated wear factor calls for, regardless of production, variations in the degree of the tightness of the metal-to-metal rubbing fit when initially assembled.

The opposite end portions of the dogbone shaft 36 are respectively provided with male gear teeth 49. The inside of the main shaft 25 and the inside of the rotor tooth member 32 are respectively provided with female gear teeth 50. The male and female gear teeth 49 and 50 are disposed to engage each other and provide a driving connection therebetween; see FIGS. 1 and 8.

Figure 8:
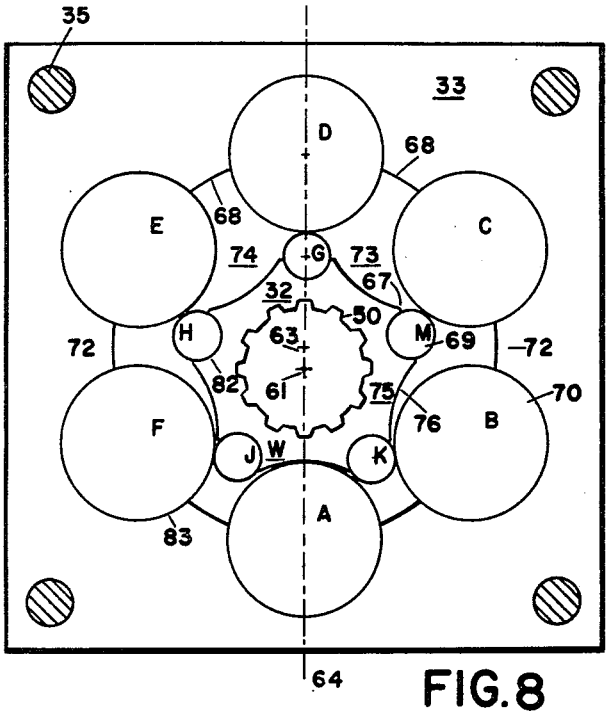
FIG. 8 is a combination view of the stator and rotor tooth members coordinated in size with respect to each other and showing the female dogbone teeth.

As shown in FIG. 8, the rotor tooth member 32 has a longitudinal rotor axis 61 and the stator tooth member 33 has a longitudinal stator axis 63 substantially parallel to the rotor axis 61 and being in axial alignment with the rotary valve axis 38. The rotor axis 61 and the stator axis 63 are mutually spaced apart one from the other and define a transverse line of eccentricity 64 passing therethrough. The longitudinal rotor axis 61 and the longitudinal stator axis 63 are disposed to revolve in an orbital cycle relative to each other, which means that the transverse line of eccentricity rotates therewith at orbit speed.

The rotor tooth member 32 has an outer face 67. The outer face 67 has the rotor axis 61 as a center. The stator tooth member 33 has an inner face 68. The inner face 68 has the stator axis 63 as a center.

The rotor tooth member 32 has a plurality of cylindrical rotor teeth 69 projecting outwardly from the outer face 67. All of said rotor teeth 69 have substantially the same rotor tooth diameter and are spaced apart one from the other in a circumferential direction. The stator tooth member 33 has a plurality of cylindrical stator teeth 70 projecting inwardly from the inner face 68. All of said stator teeth 70 have substantially the same stator tooth diameter and are spaced apart one from the other in a circumferential direction and define parallel adjacent cylindrical stator teeth having substantially equal stator intervals 72 therebetween.

Preferably, the rotor tooth member 32 is provided with five rotor teeth 69 and the stator tooth member 33 is provided with six stator teeth 70. Thus, the rotor teeth 69 are one less in number than the number of the stator teeth 70. The rotor teeth 69 and the stator teeth 70 are disposed to intermesh with each other and form two fluid chambers 73 and 74 therebetween. The fluid chambers 73 and 74 are disposed to be oppositely pressurized by the operation of the rotary valve member 28, whereby when one is pressurized the other is at exhaust pressure. The fluid chambers may be referred to as exandable and contractable fluid chambers.

The rotor tooth member 32 defines a plurality of rotor body portions 75 between the rotor teeth thereof. All of the rotor body portions 75 have substantially the same circumferential width and are respectively provided with longitudinal concave sockets 76. The stator teeth 70 have a diameter greater than the circumferential width of the rotor body portions 75. In FIG. 8, one of the concave sockets 76 is being referred to as a middle concave socket and is identified by the letter W. For explanation purpose, one of the stator teeth is being referred to as a middle stator tooth and is identified by the letter A. The remaining stator teeth 70 are identified by the letters B, C, D, E and F. The rotor teeth are identified by the letters G, H, J, K and M.

The middle concave socket W and the middle stator tooth A are disposed to provide a concave-to-convex contact relationship therebetween. See FIG. 9. The middle stator tooth A in said contact relationship defines an individual stator tooth axis 78. The middle concave socket W in said contact relationship defines an individual socket axis 79. The transverse line of eccentricity 64 is disposed to pass through the individual stator axis 78 and the individual socket axis 79. The transverse line of eccentricity 64 also passes through the center axes of the rotor tooth G and the stator tooth D which define a convex-to-convex contact engagement. The concave-to-convex contact relationship is disposed to sealingly separate said fluid chambers 73 and 74 from each other at a first location and the convex-to-convex engagement is disposed to sealingly separate the fluid chambers 72 and 74 from each other at a second location substantially diametrically opposite said first location.

The flow of fluid to and from the expandable and contractable fluid chambers through the stationary valve openings 48, is commutated by the rotary valve 28 and is related in a timing sense, with respect to the rotation of the transverse line of eccentricity 64.

Figure 6:
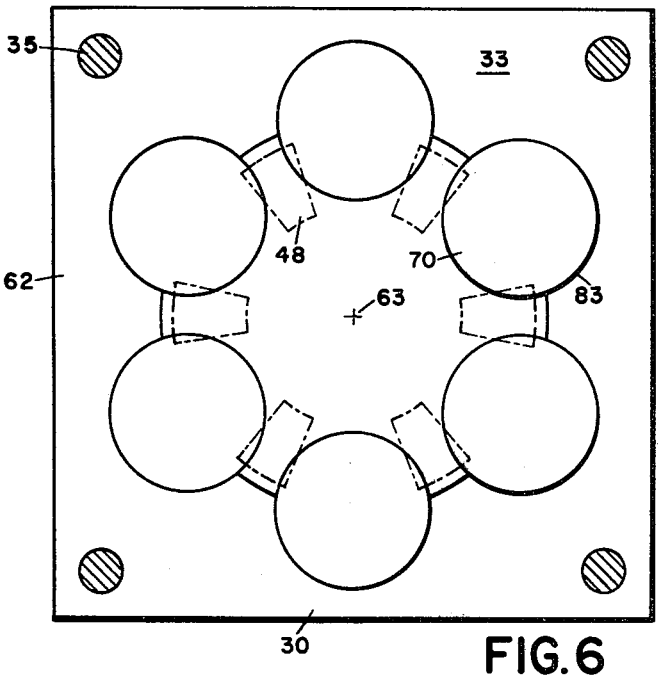
FIG. 6 is a diagrammatical profile view of the stator tooth member, wherein the circles represent cylindrical stator teeth respectively mounted in fragmental cylindrical recesses.

The rotary valve member 28 in FIG. 4 and the stationary valve openings 48 in FIG. 3 are shown in a mechanical sense and not in a timing sense with respect to the rotation of the transverse line of eccentricity 64. The position of the stationary valve openings 48 in FIG. 6 is the correct showing, in a timing sense. As noted in FIG. 1, which is a showing in a mechanical sense, the purpose is to show that there is open fluid communication between the valve chamber 15 and one of the stationary valve openings 48 and between the valve chamber 16 and another one of the stationary valve openings 48. As the rotary valve member 28 is rotated, there are a rapid succession of commutated cross-over periods in the valve porting which takes place at orbit speed. The cross-over periods rotate in harmony with the rotation of the transverse line of eccentricity to control the flow of fluid to and from the fluid chambers 73 and 74 through the stationary valve openings 48, as commutated by the rotary valve member 28. The side edge portion 30 of the stationary valve member 29 in FIG. 3 is shown as a bottom edge portion in FIG. 6.

Figure 9:
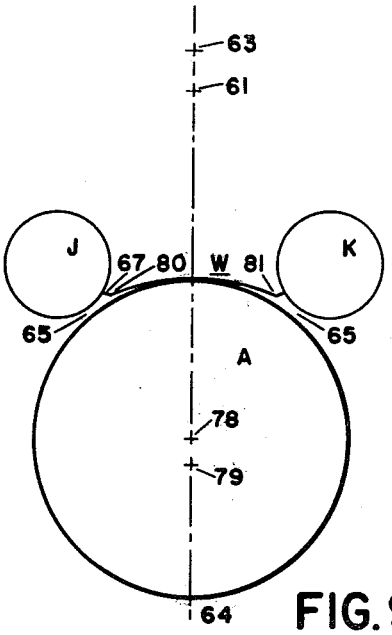
FIG. 9 is a diagrammatical view showing an enlarged and exaggerated representation of two adjacent rotor teeth and a middle stator tooth disposed therebetween, and illustrating the concave-to-convex contact relationship between the middle concave socket and the middle stator tooth.

The rotor cylindrical teeth 69 are respectively mounted in fragmented cylindrical rotor recesses 82. The rotor tooth diameter of the rotor teeth 69 and the diameter of the cylindrical rotor recesses 82 are substantially the same. The stator cylindrical teeth 70 are respectively mounted in fragmental cylindrical recesses 83. The stator tooth diameter of the stator teeth 70 and the diameter of the cylindrical stator recesses 83 are substantially the same. A close clearance fit is preferably provided between the teeth and the recesses. As shown, the diameter of the rotor teeth 69 is larger than the stator intervals 72 between stator teeth 70. As can be seen in FIG. 9, the middle concave socket W defines two end portions 80 and 81. The middle stator tooth A and the middle concave socket W are disposed to continuously contact each other from one end portion to the other end portion as the transverse line of eccentricity rotates. The diameter of the rotor teeth 69 bear a tooth ratio to the diameter of the stator teeth. In FIG. 7, it is noted that the rotor teeth 69 are larger than they are in FIG. 8. This illustrates the fact that the tooth ratio with respect to size may be varied between the rotor and stator teeth.

In operation, all the rotor and stator teeth; namely, G-D, H-E, J-F, K-B, and M-C are disposed to contact each other, except the middle stator tooth A is spaced a slight travel distance from each of the two adjacent rotor teeth J and K; see FIG. 9 which is an exaggerated view. The slight travel distances are identified by the reference characters 65 and are in the order of about two-thousandths of an inch, which would allow some internal leakage, but not to a great extent. As will be seen, the internal leakage is blocked by the fluid seal effected by the concave-to-convex relationship between the middle stator tooth A and the middle concave socket W on the transverse line of eccentricity. The fluid seal remains effective until contact engagement is made between the middle stator tooth A and one of the two adjacent rotor teeth J or K, depending upon the direction of rotation. As a result, the internal leakage allowed by the slight travel distance is totally blocked by the concave-to-convex relationship. As noted in FIG. 9, the middle concave socket W defines a larger diameter than that of the middle stator tooth A. The center for the middle concave socket W is identified by the reference character 79 and the center for the middle stator tooth A is identified by the reference character 78. The fluid seal thus remains continuous as the transverse line of eccentricity 64 rotates.

The mechanical support effected by the concave-to-convex relationship is also continuous as the transverse line of eccentricity 64 rotates. The mechanical support thereby effected is helpful for smooth orbiting of the tooth members 32 and 33. The need for a revolving crank as a support or other equivalent arrangement is eliminated. The orbital movement between the tooth member 32 and the stator tooth member 33 is exceptionally smooth in my cylindrical tooth set.

The tooth ratio with respect to the number of teeth is illustrated herein as being five-to-six. A tooth ratio of seven-to-eight may be used where there are seven rotor teeth and eight stator teeth. Other odd-to-even tooth ratios may be used provided the conditions respecting the transverse line of eccentricity are satisfied.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the inventon as hereinafter claimed.

What is claimed is:

1. A cylindrical tooth set comprising an axleless rotor tooth member having a longitudinal rotor axis, a stator tooth member surrounding said rotor tooth member and having a longitudinal stator axis substantially parallel to said rotor axis, said rotor axis and said stator axis being mutually spaced apart from each other and defining a transverse line of eccentricity passing therethrough, said axleless rotary tooth member being internally unsupportable, the longitudinal axis of one of said tooth members being disposed to move in an orbital cycle about the longitudinal axis of the other of said tooth members, said rotor tooth member having an outer face, said outer face having said rotor axis as a center, said stator tooth member having an inner face, said inner face having said stator axis as a center, said rotor tooth member having mounted therein a plurality of rotor cylindrical teeth projecting outwardly from said outer face thereof, all of said rotor teeth having substantially the same rotor tooth diameter and being spaced apart one from the other in a circumferential direction, said stator tooth member having mounted therein a plurality of stator cylindrical teeth projecting inwardly from said inner face thereof, said rotor teeth being one less in number than the number of said stator teeth, all of said stator teeth having substantially the same stator tooth diameter and being spaced apart one from the other in a circumferential direction, said rotor and stator teeth being disposed to intermesh with each other and form expandable and contractable fluid chambers therebetween, said rotor tooth member defining a plurality of rotor body portions between the rotor teeth thereof, all of said rotor body portions having substantially the same circumferential width and respectively being provided with a longitudinal concave socket, one of said concave sockets being referred to as a middle concave socket and one of said plurality of cylindrical stator teeth being referred to as a middle stator tooth, said middle concave socket and said middle stator tooth being disposed to provide a concave-to-convex contact relationship therebetween, said middle stator tooth in said contact relationship defining an individual stator tooth axis, said concave socket in said relationship defining an individual socket axis, said transverse line of eccentricity passing through said individual stator tooth axis and said individual socket axis, said concave sockets respectively defining a socket diameter greater than the diameter of said stator teeth.

2. The structure of claim 1, wherein said rotor tooth member is provided with a plurality of an odd number of cylindrical teeth and said stator tooth member is provided with a plurality of an even number of cylindrical teeth.

3. The structure of claim 1, wherein said concave-to-convex contact relationship is disposed to support said rotor and stator tooth members relative to each other.

4. The structure of claim 1, wherein said rotor and stator teeth respectively including a single rotor tooth and a single stator tooth disposed to provide a convex-to-convex contact engagement therebetween, said single rotor tooth having a center rotor tooth axis, said single stator tooth having a center stator tooth axis, said transverse line of eccentricity passing through said center rotor tooth axis and said center stator tooth axis, said concave-to-convex contact relationship being disposed to sealingly separate said fluid chambers from each other at a first location, said convex-to-convex contact engagement being disposed to sealingly separate said fluid chambers from each other at a second location substantially diametrically opposite said first location.

5. The structure of claim 1, wherein said plurality of cylindrical rotor teeth include two adjacent rotor teeth, said middle stator tooth having a mid-position between said two adjacent rotor teeth, said middle stator tooth in said mid-position being spaced a slight distance from each of said two adjacent rotor teeth.

6. The structure of claim 1, wherein said stator tooth diameter is greater than said rotor tooth diameter.

7. The structure of claim 1, wherein said rotor teeth are respectively mounted in fragmental cylindrical rotor recesses, said rotor teeth and said rotor recesses having substantially the same diameter.

8. The structure of claim 1, wherein said stator teeth are respectively mounted in fragmental cylindrical stator recesses, said stator teeth and said stator recesses having substantially the same diameter.

9. The structure of claim 1, wherein said rotor tooth member is provided with five rotor teeth and said stator tooth member is provided with six stator teeth.

10. The structure of claim 1, wherein said middle concave socket defines two end portions, said concave-to-convex contact relationship being disposed to provide continuous contact from one end portion to the other end portion as the transverse line of eccentricity rotates.

* * * * *